US011032658B2

(12) United States Patent
Hu et al.

(10) Patent No.: US 11,032,658 B2
(45) Date of Patent: Jun. 8, 2021

(54) SPEAKER

(71) Applicant: AAC Technologies Pte. Ltd., Singapore (SG)

(72) Inventors: Hongjian Hu, Shenzhen (CN); Shuai Li, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/727,971

(22) Filed: Dec. 27, 2019

(65) Prior Publication Data

US 2020/0314576 A1 Oct. 1, 2020

(30) Foreign Application Priority Data

Mar. 29, 2019 (CN) ..... 201920415999.4

(51) Int. Cl.

| | |
|---|---|
| ***H04R 9/06*** | (2006.01) |
| ***H04R 31/00*** | (2006.01) |
| ***H04R 7/18*** | (2006.01) |
| ***H04R 9/02*** | (2006.01) |
| ***H04R 7/12*** | (2006.01) |
| ***H04R 9/04*** | (2006.01) |

(52) U.S. Cl.

CPC ..... *H04R 31/006* (2013.01); *H04R 7/12* (2013.01); *H04R 7/18* (2013.01); *H04R 9/025* (2013.01); *H04R 9/043* (2013.01); *H04R 9/06* (2013.01); *H04R 2400/07* (2013.01); *H04R 2400/11* (2013.01)

(58) Field of Classification Search

CPC . H04R 7/12; H04R 7/18; H04R 9/025; H04R 9/043; H04R 9/06; H04R 11/02; H04R 2400/03; H04R 2400/07; H04R 2400/11

See application file for complete search history.

(56) References Cited

U.S. PATENT DOCUMENTS

| | | | | |
|---|---|---|---|---|
| 6,208,237 | B1 * | 3/2001 | Saiki | H04M 1/03 340/388.1 |
| 6,570,993 | B1 * | 5/2003 | Fukuyama | G10K 9/22 381/396 |
| 6,618,487 | B1 * | 9/2003 | Azima | H04R 1/24 381/152 |
| 10,277,986 | B2 * | 4/2019 | Li | H04R 9/043 |

* cited by examiner

*Primary Examiner* — Huyen D Le

(74) *Attorney, Agent, or Firm* — W&G Law Group LLP

(57) ABSTRACT

The present invention discloses a speaker having a frame, a vibrating system and a magnetic circuit system both fixed on the frame. The magnetic circuit system having a yoke fixed on the frame. The speaker further includes a suspension having a first fixing portion fixed with the frame. The first fixing portion includes a main body portion located in the middle of the first fixing portion and a welding pad portion formed by bending from two opposite ends of the main body portion toward a direction away from both the main body portion and the yoke. The frame includes a first surface connected to the first fixing portion and an avoiding portion formed by recessing from the first surface toward a direction away from the yoke. The welding pad portion is accommodated in the avoiding portion. A total height of the spealer is reduced.

10 Claims, 7 Drawing Sheets

IV-IV

V-V

SPEAKER

FIELD OF THE PRESENT INVENTION

The present invention relates to the field of electronic equipment technology, and more particularly to a speaker.

DESCRIPTION OF RELATED ART

With the advent of the mobile Internet era, the number of smart mobile devices is continuously increasing. Among numerous mobile devices, mobile phones are undoubtedly the most common and portable mobile terminal devices. At present, mobile phones have diverse functions, one of which is a high-quality music function, and a speaker in a mobile phone is one of necessary conditions to achieve the high-quality music function.

In the related art, a speaker has a frame, a diaphragm fixed on a first side of the frame and a yoke fixed on a second side of the frame, a suspension having a welding pad portion fixed on the second side and a voice coil connected with the diaphragm for driving the diaphragm. A height of the speaker is affected by a height of the voice coil. When the height of the voice coil is increased, a connecting surface of the suspension and the frame is correspondingly moved toward the yoke, thus a distance between the welding pad portion of the suspension and the yoke is reduced, thereby increasing the height of the speaker or reducing a size of the yoke.

Therefore, it is desired to provide a new speaker which can overcome the above-mentioned problems.

SUMMARY OF THE PRESENT INVENTION

The purpose of the present invention is to overcome the above-mentioned problems by providing a speaker which is benefit for enlarging a size of the yoke.

To achieve the above purpose, the present invention provides a speaker comprising a frame, a vibrating system, a suspension and a magnetic circuit system fixed on the frame respectively. The magnetic circuit system comprises a yoke fixed on the frame. The suspension includes a first fixing portion connected to the frame. The first fixing portion includes a main body portion located at an intermediate position thereof, and a welding pad portion formed by bending from two opposite ends of the main body portion toward a direction away from both the main body portion and the yoke. The frame includes a first surface connected to the first fixing portion, and an avoiding portion formed by recessing from the first surface toward a direction away from the yoke. The welding pad portion is accommodated in the avoiding portion.

Preferably, the first fixing portion further includes a transition portion connecting the main body portion with the welding pad portion. The transition portion extends obliquely from one end of the main body portion toward a direction away from both the main body portion and the yoke.

Preferably, both the main body portion and the welding pad portion are planar sheets. The welding pad portion extends horizontally from an end of the transition portion away from the main body portion toward a direction away from the main body portion and perpendicular to a vibrating direction of the vibrating system.

Preferably, a height difference along the vibrating direction of the vibrating system between the main body portion and the welding pad portion is 0.1 mm.

Preferably, the avoiding portion includes a second surface close to the welding pad portion. The second surface includes a welding surface fixed on the welding pad portion by welding. A projection of the welding pad portion along the vibrating direction of the vibrating system is totally overlapped with a projection of the welding surface along the vibrating direction of the vibrating system.

Preferably, the area of the second surface is larger than the area of the welding surface.

Preferably, a projection of the transition portion along the vibrating direction is totally located on the second surface.

Preferably, the vibrating system further includes a diaphragm fixed on the frame and a voice coil for driving the diaphragm for vibrating and producing sound. The suspension further includes a second fixing portion connecting to an end of the voice coil away from the diaphragm and an elastic portion connecting the first fixing portion with the second fixing portion.

Preferably, the first fixing portion, the elastic portion, and the second fixing portion are configured as an integrated structure.

Preferably, the vibrating system further includes an auxiliary diaphragm sandwiched and configured between the main body portion and the frame.

Compared with the related art, in the speaker of the present invention, the first fixing portion and the welding pad portion are arranged on different horizontal planes, so that the welding pad portion is farther from the yoke than the first fixing portion. Meanwhile, the frame is recessed toward a direction away from the yoke to form an avoiding portion for accommodating the welding pad portion, thereby a spaced distance between the welding pad portion and the yoke is increased, which is benefit for enlarging the size of the yoke.

BRIEF DESCRIPTION OF THE DRAWINGS

The embodiment of the present invention will be more clearly understood from the following drawings. It is obvious that the following described drawings are barely some embodiments of the invention. For the person skilled in the art, he can achieve the other drawings from these drawings without any creative work.

DETAILED DESCRIPTION OF THE EXEMPLARY EMBODIMENT

The technical solution in the embodiments of the invention will be clearly and completely described by combining with the drawings in the embodiments of the invention. Apparently, the described embodiments are only parts of the embodiments of the invention, but not all of the embodiments. Based on these embodiments, all the other embodiments that the person skilled in the art can achieve without making creative work, are belong to the scope of protection of the invention.

Figure 1:
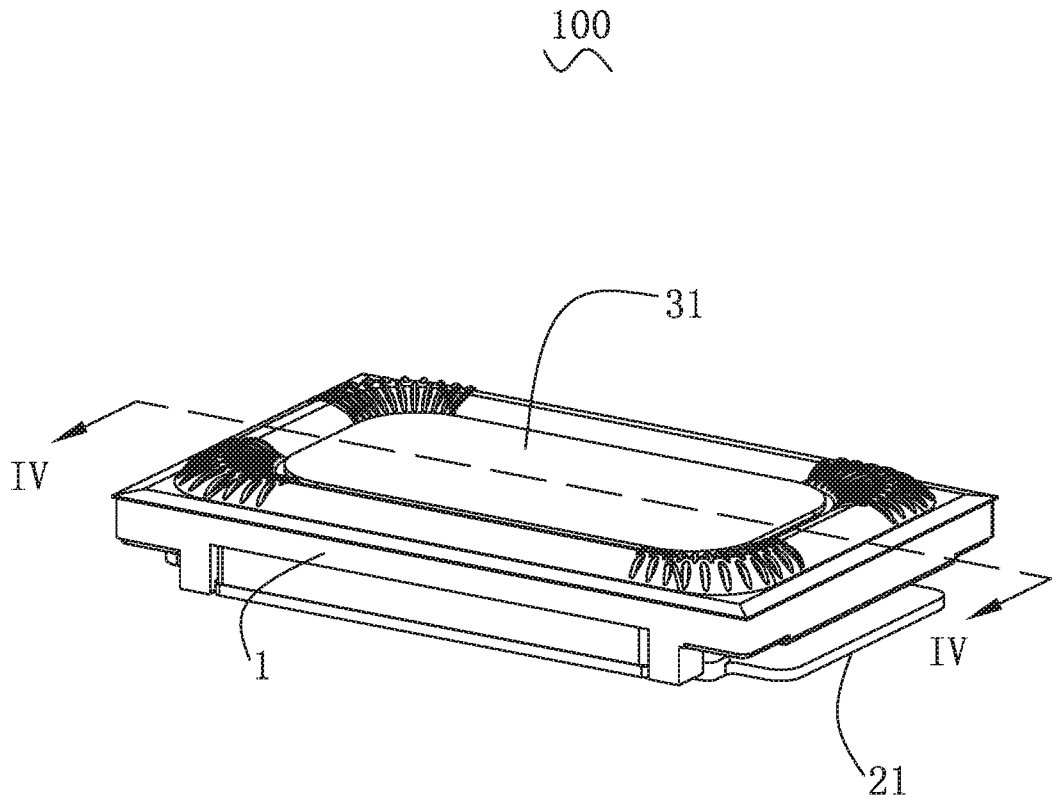
FIG. 1 is an illustrative assembled view a speaker according to the present invention.
Figure 2:
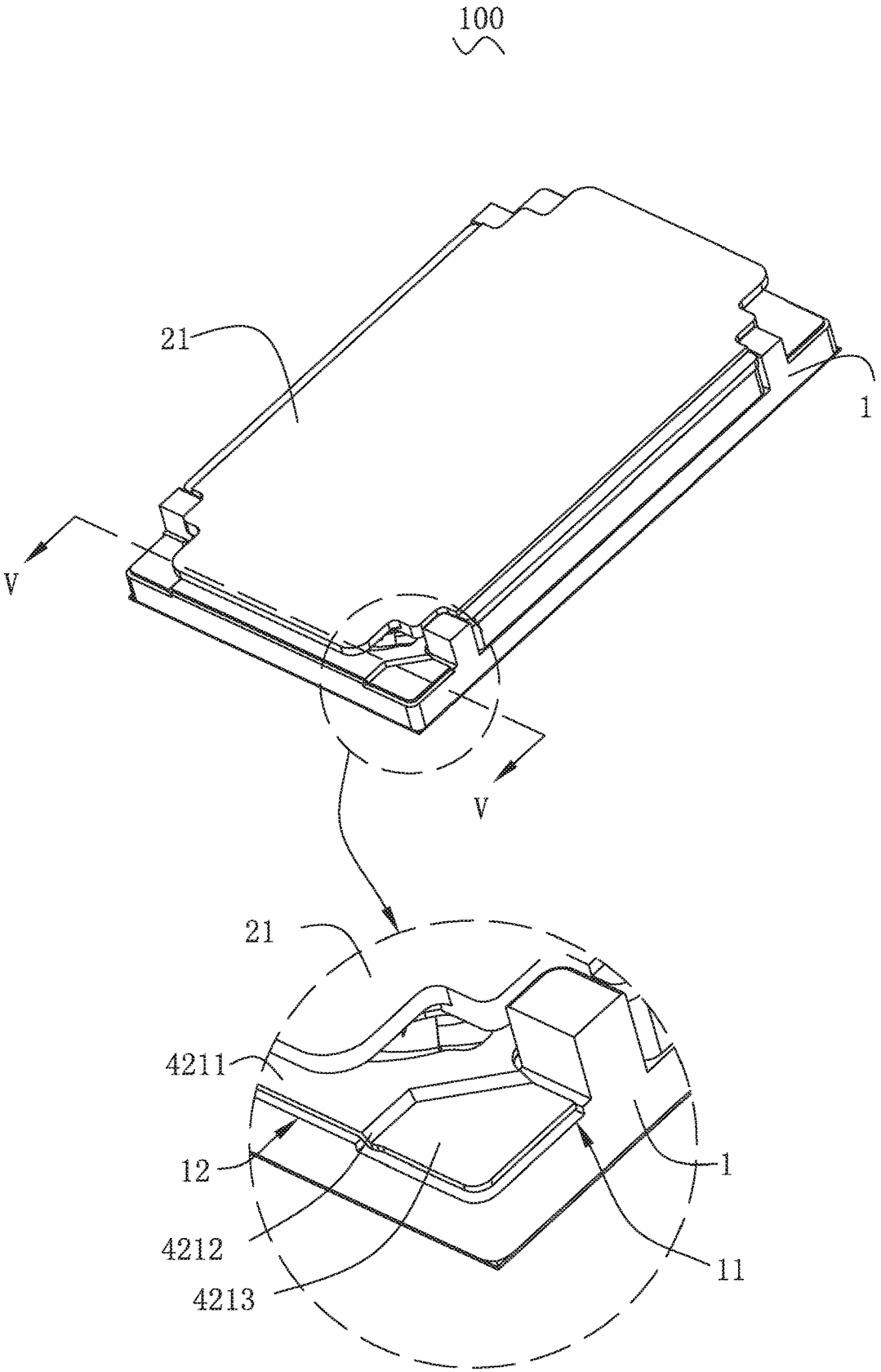
FIG. 2 is an illustrative assembled view of another aspect of the speaker according to the present invention.
Figure 3:
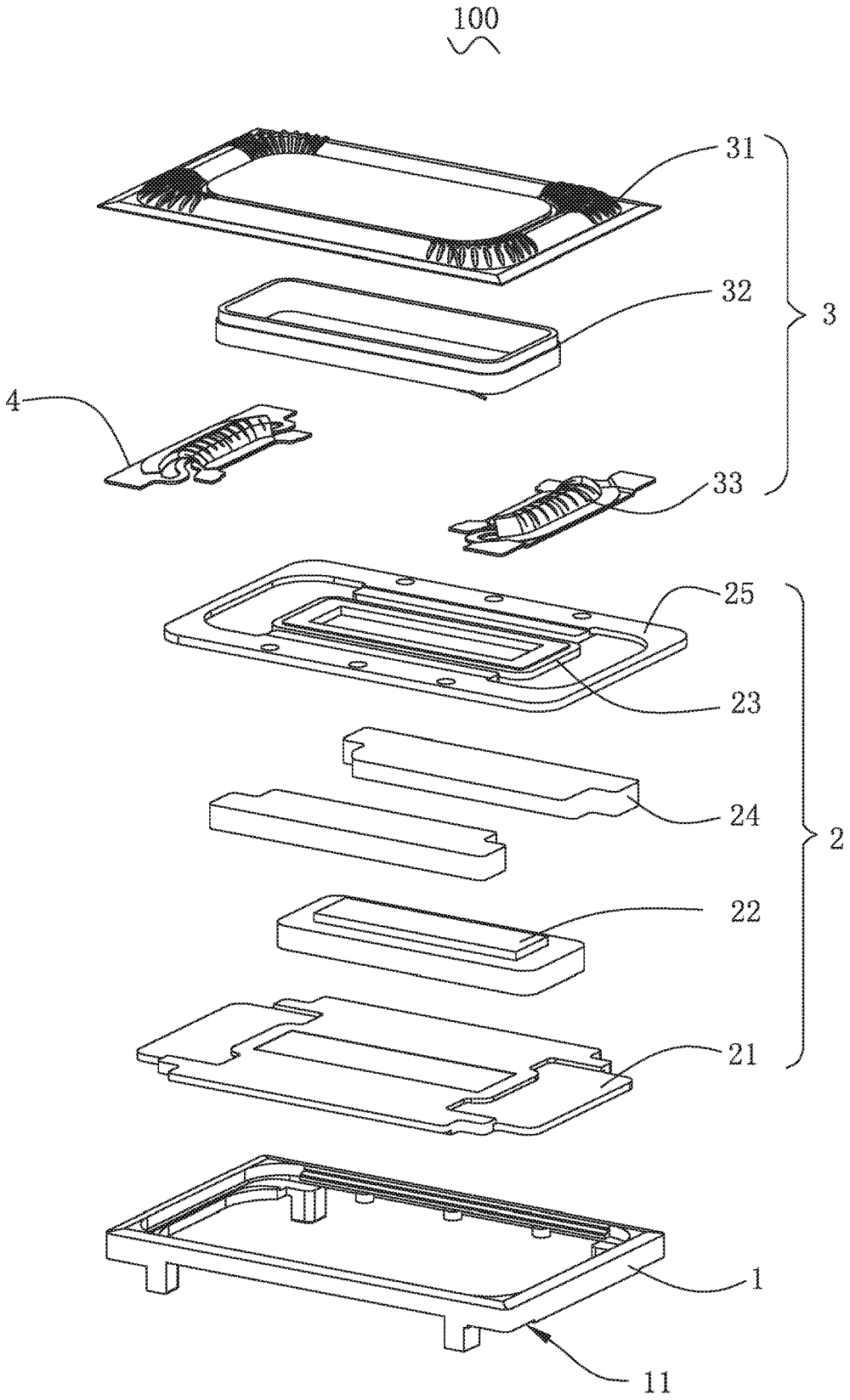
FIG. 3 is an illustrative exploded view of the speaker shown in FIG. 1.
Figure 4:
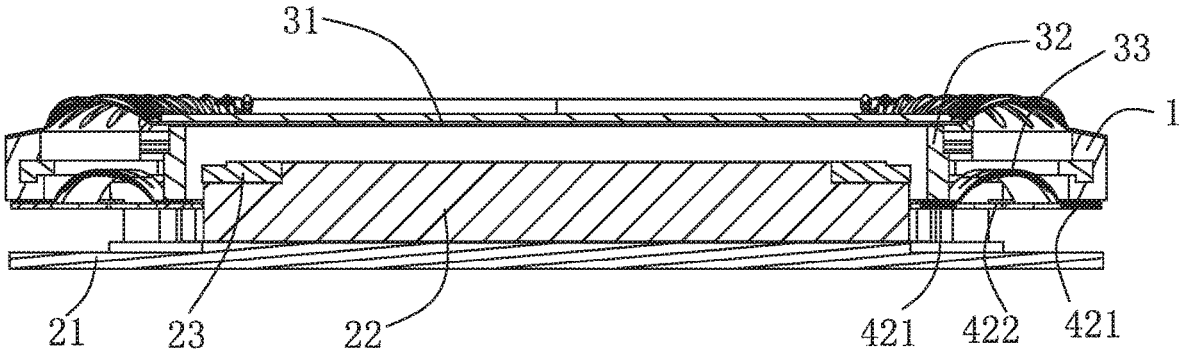
FIG. 4 is a cross-sectional view of the speaker taken along a line IV-IV shown in FIG. 1.

Referring to FIGS. 1-4, FIG. 1 is a illustrative assembled view of a speaker according to the present invention. FIG. 2 is a illustrative assembled view of another aspect of the speaker according to the present invention. FIG. 3 is an illustrative exploded view of the speaker shown in FIG. 1. FIG. 4 is a cross-sectional view of the speaker taken along a line Iv-Iv shown in FIG. 1. The present invention provides a speaker comprising a frame 1, a magnetic circuit system 2, a vibrating system 3 and a suspension 4 all fixedly arranged on the frame 1.

The magnetic circuit system 2 includes a yoke 21 fixed on the frame 1 and forming a receiving space together with the frame 1, a main magnet 22, a main pole plate 23 attached to an upper surface of the main magnet 22, secondary magnets 24 arranged surrounding the main magnet 22 and a secondary pole plate 25 attached to an upper surface of the secondary magnets 24. Both the main magnet 22 and the secondary magnets 24 are fixed on the yoke 21, wherein the main magnet 22 is located on the middle position of the yoke 21, the secondary magnets 24 are located on both sides of the main magnet 22 and spaced apart from the main magnet 22 to form a magnetic gap.

The vibrating system 3 includes a diaphragm 31, a voice coil 32 and an auxiliary diaphragm 33. The diaphragm 31 is fixed above the frame 1. The voice coil 32 is fixed below the diaphragm 31 and inserted into the magnetic gap to generate electromagnetic force with the magnetic circuit system 2 after being provided with electric power, thereby driving the diaphragm 31 to vibrate and produce sound. The auxiliary diaphragm 33 is fixed on the suspension 4, one end of the suspension 4 is fixed on the voice coil 32, and the other end is fixed on the frame 1. The suspension 4 is used for fixing and supporting the voice coil 32 and conducting electricity to the voice coil 32. The suspension 4 is located between the yoke 21 and the frame 1.

Figure 5:
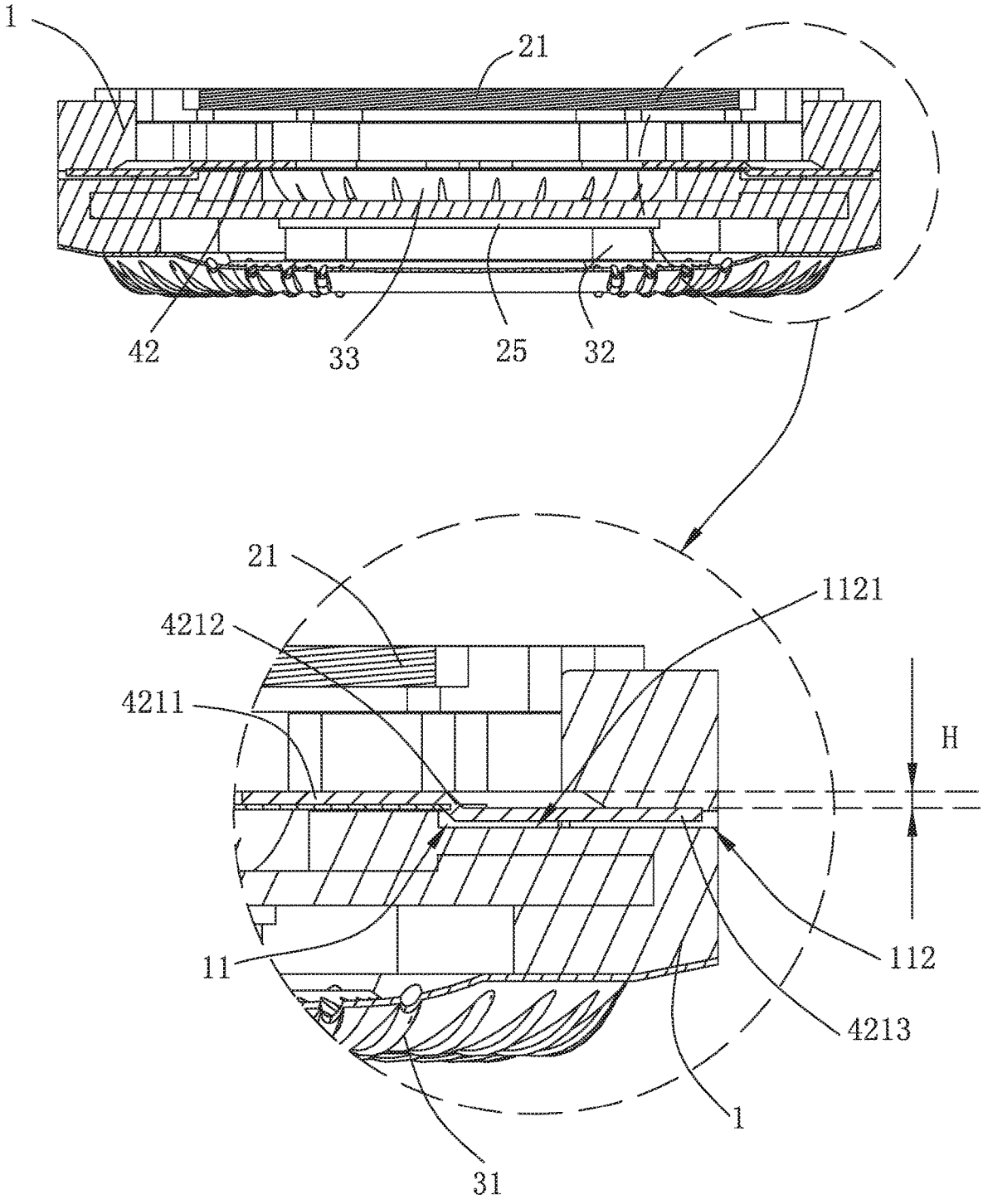
FIG. 5 is a cross-sectional view of the speaker taken along a line V-V shown in FIG. 2.
Figure 6:
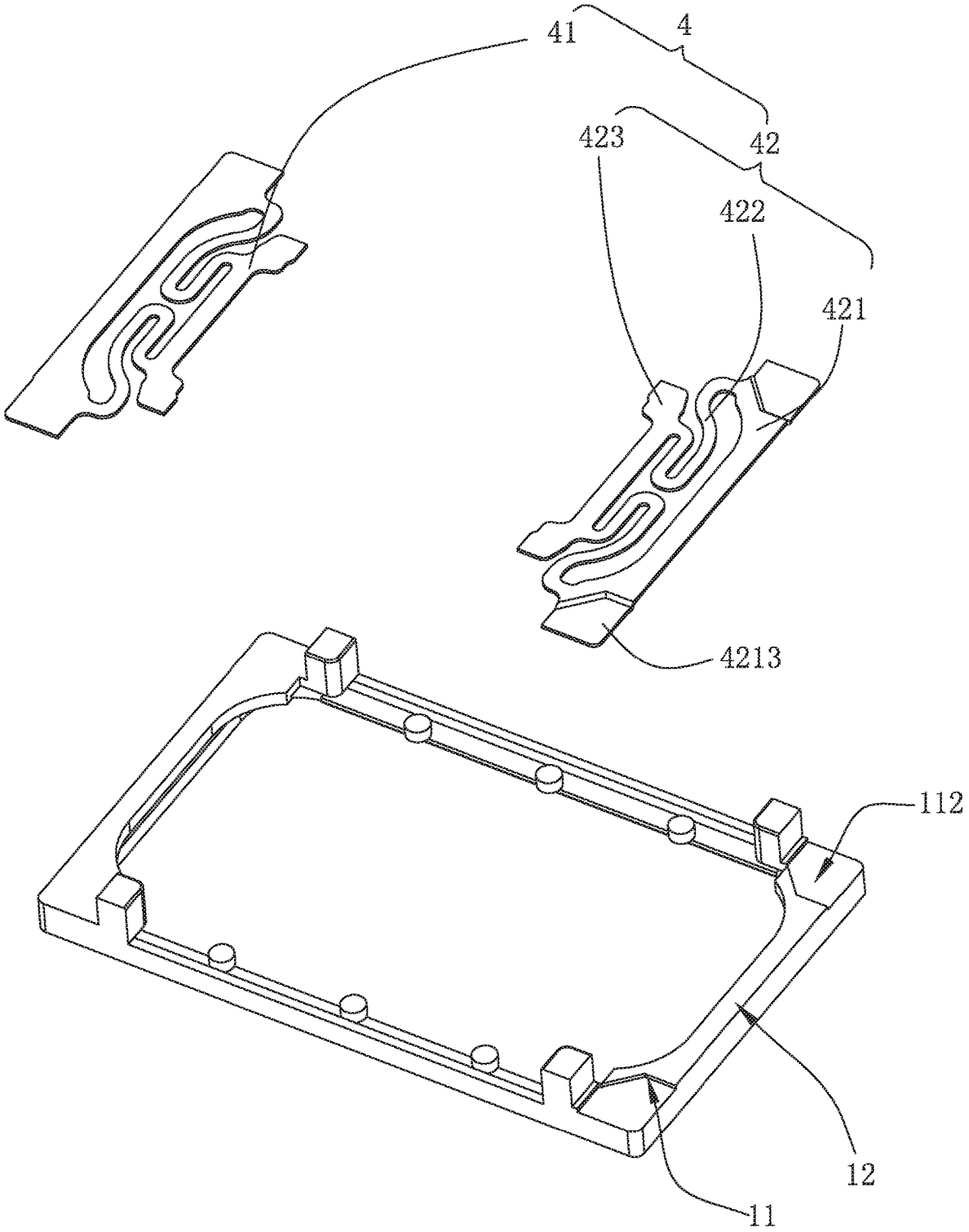
FIG. 6 is an illustrative assembled view of a first suspension, a second suspension and a frame.
Figure 7:
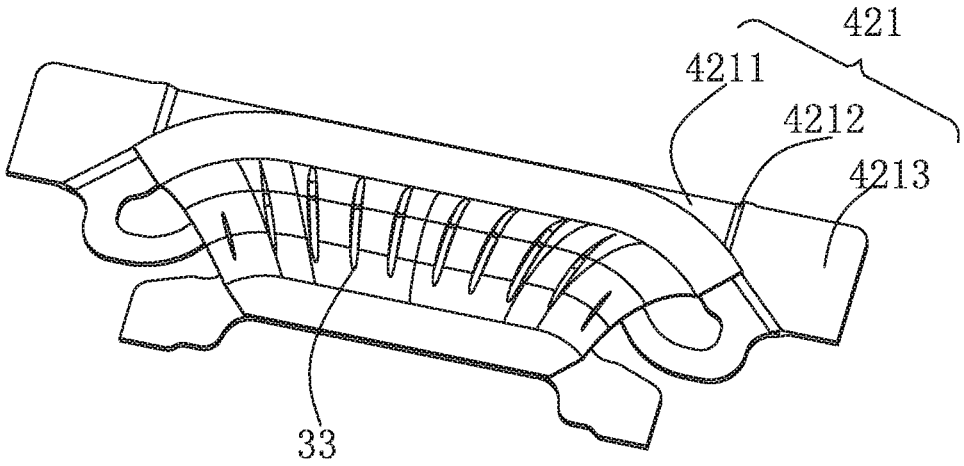
FIG. 7 is an illustrative assembled view of the second suspension and an auxiliary diaphragm.

Referring to FIGS. 5-7, FIG. 5 is a cross-sectional view of the speaker taken along a line V-V shown in FIG. 2. FIG. 6 is an illustrative assembled view of a first suspension, a second suspension and the frame. FIG. 7 is an illustrative assembled view of the second suspension and an auxiliary diaphragm. The suspension 4 includes a first suspension 41 and a second suspension 42 fixed to two opposite ends of the frame 1 respectively. The first suspension 41 is a planar sheet as a whole. The second suspension 42 includes a first fixing portion 421 connected to the frame 1, a second fixing portion 423 connected to an end of the voice coil 32 away from the sound diaphragm 31, and an elastic portion 422 connecting the first fixing portion 421 with the second fixing portion 423. The elastic portion 422 is in a bent shape and capable of providing with elastic force.

The first fixing portion 421 includes a main body portion 4211 located at an intermediate position, a welding pad portion 4213 formed by bending from two opposite ends of the main body portion 4211 toward a direction away from the main body portion 4211 and away from the yoke 21, and a transition portion 4212 connecting the main body portion 4211 with the welding pad portion 4213.

It should be noted that three structures can be formed between the first suspension 41 and the second suspension 42. Namely, both the first suspension 41 and the second suspension 42 are configured as a planar structure as a whole; both the suspension 41 and the second suspension 42 are provided with a welding pad portion which is not on the same level with the first fixing portion; either the first suspension 41 or the second suspension 42 is configured as a planar structure as a whole, the other is provided with a welding pad portion which is not on the same level with the first fixing portion. The above three structures should all belong to the protection scope of the present invention.

Specifically, the auxiliary diaphragm 33 is sandwiched and configured between the main body portion 4211 and the frame 1.

Specifically, the transition portion 4212 is formed by extending obliquely from an end of the main body portion 4211 toward a direction away from both the main body portion 4211 and the yoke 21.

Specifically, both the main body portion 4211 and the welding pad portion 4213 are planar sheets. The welding pad portion 4213 is formed by horizontally extending from an end of the transition portion 4212 away from the main body portion 4211 toward a direction away from the main portion 4211 and perpendicular to the vibrating direction of the vibrating system 3.

Specifically, there is a height difference H along the vibrating direction of the vibrating system 3 between the main body portion 4211 and the welding pad portion 4213. Preferably, the height difference H is 0.1 mm. The welding pad portion 4213 and the main body portion 4211 are located on different horizontal planes with the above structure. The welding pad portion 4213 relative to the main body portion 4211 is further away from the yoke 21. Therefore a gap between the welding pad portion 4213 and the yoke 21 is increased, which is benefit for enlarging a size of the yoke 21.

Furthermore, the frame 1 includes a first surface 12 connected to the first fixing portion 421 and an avoiding portion 11 formed by recessing from the first surface 12 toward a direction away from the yoke 21. The welding pad portion 4213 is accommodated in the avoiding portion 11.

The avoiding portion 11 includes a second surface 112 close to the welding pad portion 4213. The second surface 112 includes a welding surface 1121 fixed on the welding pad portion 4213 by welding. A projection of the welding pad portion 4213 along the vibrating direction is fully overlapped with a projection of the welding surface 1121 along the vibrating direction of the vibrating system 3. The area of the second surface 112 is larger than the area of the welding surface 1121. A projection of the transition portion 4212 along the vibrating direction of the vibrating system 3 is totally located on the second surface 112.

Compared with the related art, in the speaker of the present invention, the first fixing portion and the welding pad portion are arranged on different horizontal planes, so that the welding pad portion is further from the yoke than the first fixing portion. Meanwhile, the frame is recessed toward a direction away from the yoke to form an avoiding portion for accommodating the welding pad portion, thereby a spaced distance between the welding pad portion and the yoke is increased, which is benefit for reducing a height of the speaker and enlarging the size of the yoke.

The above is only preferred embodiment of the present invention, it should be noted that those skilled in the art can still make improvements without departing from the inventive concept, but these are all belong to the protection scope of the present invention.

What is claimed is:

1. A speaker, comprising a frame, a vibrating system, a suspension and a magnetic circuit system fixed on the frame respectively, the magnetic circuit system comprising a yoke fixed on the frame, wherein, the suspension includes a first fixing portion connected to the frame, the first fixing portion includes a main body portion located at an intermediate position thereof, and a welding pad portion formed by bending from two opposite ends of the main body portion toward a direction away from both the main body portion and the yoke; and the frame includes a first surface connected to the first fixing portion, and an avoiding portion formed by recessing from the first surface toward a direction away from the yoke, the welding pad portion is accommodated in the avoiding portion;

the vibrating system further includes a diaphragm fixed on the frame and a voice coil for driving the diaphragm for vibrating and producing sound, the suspension further includes a second fixing portion connecting to an end of the voice coil away from the diaphragm and an elastic portion connecting the first fixing portion with the second fixing portion.

2. The speaker according to claim 1, wherein the first fixing portion further includes a transition portion connecting the main body portion with the welding pad portion, the transition portion extends obliquely from one end of the main body portion toward a direction away from both the main body portion and the yoke.

3. The speaker according to claim 2, wherein both the main body portion and the welding pad portion are planar sheets, the welding pad portion extends horizontally from an end of the transition portion away from the main body portion toward a direction away from the main body portion and perpendicular to a vibrating direction of the vibrating system.

4. The speaker according to claim 2, wherein a height difference along the vibrating direction of the vibrating system between the main body portion and the welding pad portion is 0.1 mm.

5. The speaker according to claim 2, wherein the avoiding portion includes a second surface close to the welding pad portion; the second surface includes a welding surface fixed on the welding pad portion by welding, and a projection of the welding pad portion along the vibrating direction of the vibrating system is totally overlapped with a projection of the welding surface along the vibrating direction of the vibrating system.

6. The speaker according to claim 5, wherein the area of the second surface is larger than the area of the welding surface.

7. The speaker according to claim 6, wherein a projection of the transition portion along the vibrating direction is totally located on the second surface.

8. The speaker according to claim 1, wherein a height difference along the vibrating direction of the vibrating system between the main body portion and the welding pad portion is 0.1 mm.

9. The speaker according to claim 1, wherein the first fixing portion, the elastic portion, and the second fixing portion are configured as an integrated structure.

10. The speaker according to claim 1, wherein the vibrating system further includes an auxiliary diaphragm sandwiched and configured between the main body portion and the frame.

* * * * *